US010943431B2

(12) United States Patent
Lahmi

(10) Patent No.: US 10,943,431 B2
(45) Date of Patent: Mar. 9, 2021

(54) AUGMENTED REALITY LOTTERY SYSTEM

(71) Applicant: Paul Lahmi, Paris (FR)

(72) Inventor: Paul Lahmi, Paris (FR)

( * ) Notice: Subject to any disclaimer, the term of this patent is extended or adjusted under 35 U.S.C. 154(b) by 414 days.

(21) Appl. No.: 14/904,960

(22) PCT Filed: Jul. 15, 2014

(86) PCT No.: PCT/IB2014/063114
§ 371 (c)(1),
(2) Date: Jan. 14, 2016

(87) PCT Pub. No.: WO2015/008217
PCT Pub. Date: Jan. 22, 2015

(65) Prior Publication Data

US 2016/0148464 A1 May 26, 2016

(30) Foreign Application Priority Data

Jul. 17, 2013 (FR) ..... 13 57022

(51) Int. Cl.
*G07F 17/32* (2006.01)

(52) U.S. Cl.
CPC ..... *G07F 17/3241* (2013.01); *G07F 17/329* (2013.01); *G07F 17/3218* (2013.01)

(58) Field of Classification Search
CPC ..... A63F 13/08; G06F 12/00; G07F 17/3241; G07F 17/3218; G07F 17/329
See application file for complete search history.

(56) References Cited

U.S. PATENT DOCUMENTS

| | | | | |
|---|---|---|---|---|
| 6,183,361 | B1 * | 2/2001 | Cummings | G07F 17/32 273/269 |
| 9,633,526 | B2 * | 4/2017 | Polis | G07F 17/34 |
| 9,805,554 | B2 * | 10/2017 | Michel | G07F 17/329 |
| 2007/0093299 | A1 * | 4/2007 | Bergeron | G07F 17/32 463/43 |
| 2008/0146346 | A1 * | 6/2008 | Hardy | G07F 17/32 463/42 |
| 2009/0023490 | A1 * | 1/2009 | Moshal | G07F 17/32 463/17 |

(Continued)

OTHER PUBLICATIONS

International Search Report PCT/IB2014/063114 dated Feb. 9, 2015.

*Primary Examiner* — Malina D. Blaise
(74) *Attorney, Agent, or Firm* — Nixon & Vanderhye

(57) ABSTRACT

A method of creating lottery tickets of which the possible prize will be discovered by the holder of same via a Smartphone application which, depending on the image on the ticket, will make it possible to reach, on a remote computer site, the equivalent of a draw, that is preferably pre-recorded or pre-defined and will be displayed on the Smartphone in a form equivalent to a video, thus making it possible for the holder to be able to follow and experience the draw and thus find out if he has won and, in this case, what the prize is. The distribution of the prizes, the guarantee that the draw is unique and the "new" nature of the tickets are guaranteed and managed by the remote computer system. The method makes it possible, in particular, to bring a novel appeal to lotteries based on scratchcard tickets, which are the main key to the success of this kind of lottery.

27 Claims, 6 Drawing Sheets

(56) References Cited

U.S. PATENT DOCUMENTS

2011/0086693 A1* 4/2011 Guziel ..... G07F 17/32 463/17
2012/0021822 A1* 1/2012 DeWaal ..... G07F 17/3237 463/29
2012/0077561 A1* 3/2012 Bettcher ..... A63F 3/081 463/17
2013/0084935 A1* 4/2013 DePaul ..... A63F 3/0605 463/17
2014/0106840 A1* 4/2014 Irwin, Jr. ..... G07F 17/329 463/17
2014/0378204 A1* 12/2014 Michel ..... G07F 17/329 463/17
2015/0072752 A1* 3/2015 Melnick ..... G07F 17/3239 463/20
2015/0194008 A1* 7/2015 Kolios ..... G07F 17/329 463/17
2015/0228148 A1* 8/2015 Barnes ..... G07F 17/32 463/17
2015/0269599 A1* 9/2015 Lee ..... G06Q 30/0207 705/14.14
2015/0279156 A1* 10/2015 Omar ..... G06Q 30/06 463/22
2016/0012465 A1* 1/2016 Sharp ..... G06Q 20/18 705/14.17
2016/0042602 A1* 2/2016 Phan ..... G07F 17/3237 463/29
2016/0191666 A1* 6/2016 Roireau ..... G07F 17/32 709/217
2016/0196484 A1* 7/2016 Ciavatta ..... G06F 17/30879 235/462.1
2016/0240037 A1* 8/2016 Robbins ..... G07F 17/329
2017/0236236 A1* 8/2017 Saferin ..... G06Q 50/34 705/14.3
2017/0263073 A1* 9/2017 Reid ..... G07F 17/329

* cited by examiner

AUGMENTED REALITY LOTTERY SYSTEM

BACKGROUND OF THE INVENTION

Field of the Invention

The invention consists in creating lottery tickets, the possible prize of which will be revealed by its holder by means of an application of the smartphone type, which, according to the image present on the ticket, will make it possible to obtain on a remote computer site the equivalent of a draw which is preferably pre-recorded or predefined, which will be displayed on the smartphone in a form equivalent to a video, thus allowing the holder to be able to follow and experience this draw, and therefore to discover if he has won, and in this case what the prize is. Distribution of the prizes as well as the guarantee of the uniqueness of the draw and the "new" nature of the ticket is guaranteed and controlled by the remote computer system. In particular, the invention makes it possible to create a novel attraction to lotteries based on tickets of the scratch card type, which is the main key to success of this type of lottery.

Description of the Related Art

The first lotteries were based on issuing of numbered tickets with a face value making it possible to participate in a draw distributing a certain number of prizes which could be material prizes or prizes in the form of a value. These lotteries were very successful in the past, and made it necessary to buy tickets in advance and wait for the draw, which could take place a few days later, in order to find out if the number on the ticket bought corresponded to one of the winning numbers, with possibilities of partial correspondence for so-called consolation prizes. These lotteries will be known as deferred draw lotteries. One of the particular features of these lotteries is that the ticket is always potentially a winner until the draw has taken place.

These deferred draw lotteries required a certain amount of patience on the part of the holders (often several days), and other types of lotteries which can be classified as "games of chance", and are more instantaneous, compete with these types of lotteries.

Historically, one of the oldest known games of chance is for example horse racing. It is difficult to say historically how far back the first betting on horse races dates, but it can be estimated that this took off to a certain extent starting in the $19^{th}$ century. The main advantage is that the "draw" is relatively rapid, since in general it takes place less than half an hour after the bet, or even a few minutes in the case of bets made at race courses, and in the course of the same day when the bet is made in specialized betting shops outside the racecourse. One of the advantages of these bets for the better is that he chooses his horse(s) according to criteria which can be rational, and in this case, if the horses chosen win, he can claim that his win is logical, and is distinguished from pure chance. However, in horse races there are enough uncontrolled random factors to make them nevertheless a game of chance, i.e. it is rare for a player to be able to be sure of winning before the race has taken place.

Some years ago, lotteries adapted in order to allow the buyer of a ticket to find out quickly whether he has won. For this purpose, when the tickets are issued, it is decided in advance if the ticket is a winner or loser, and if the ticket is a winner, what the win is. This type of lottery can be assimilated to drawing straws: all the straws are apparently identical, but in fact in general a single one is a winner, and it is once the straw has been selected that it is known whether it is a loser or a winner. The length of the straws is concealed in the hand of the person offering them to the various participants. Concealment of the same type is obviously difficult to envisage when lottery tickets are offered by a licensed sales point for example. The buyer must be assured that, at least in theory, before the ticket has been bought, no-one has been able to determine its winning or losing nature.

For this purpose, for some years, tickets have existed which will be known hereinafter as scratch cards, which have the particular feature that when they are produced, a concealing layer is added to the part of the ticket which allows the player to reveal whether he has won, by scratching it with either a coin or a fingernail, or with any other suitable means. This term also incorporates this type of ticket within the context of the present invention. The concealing layer can also for example be a simple cover to be removed. The efforts of those who develop tickets of this type consist in making possible a certain progressivity in the revelation of the win associated with the ticket: in general, the player firstly reveals the win which he can hope for from this ticket, then reveals one by one the elements of a combination which determine whether the win applies or not. In general this is determined at the end of revelation of the combination. Certain incorporate a plurality of draws which are presented as being independent. The player can thus lose in one or more of the draws constituted by the ticket, and win one or more times on the same ticket. The fact of increasing the number of potential draws on a single ticket mainly has the purpose of retaining the attention of the player for longer so that he "gets his money's worth" even if he does not win. In general, a large part of the "winning" tickets simply provide a win which is equal to the bet, or very close to it, thus encouraging the player to reinvest this win immediately in the purchase of new tickets.

This type of ticket is also perfectly suitable for commercial promotions, and in this case the ticket is distributed free of charge to a target public by the issuer, either when a real or potential client goes to one of the stores, the sign of which is associated with the commercial operation in progress, or when he goes to the checkout at one of these stores. This example is clearly not exhaustive, and there are numerous cases where scratch cards of this type are either issued with a designated purchase value, or distributed free of charge, or given within the context of a transaction or a specific action. Hereinafter, the person who acquires a ticket of this type will be known as the player, whether he has had to pay a sum of money or not for this acquisition, and whether the corresponding ticket comes within the scope of the present invention or not.

Some companies which offer this type of scratch card try to create equivalent tickets on the Internet, wherein, by clicking on a virtual ticket, the player triggers a virtual draw. However, in this case, the materiality of the ticket is lost, thus losing part of the attraction for the player in the same way as if tokens in casinos were eliminated and replaced purely by computer control of the bets and wins. In this case, the scratching and the draw are carried out on a single support, in this case the computer or the mobile terminal used, whereas in the present invention there is transfer of the draw of the ticket to the mobile terminal after the ticket has been scratched. This dichotomy is important, since in this way supermarkets will be able to distribute scratch cards when the client goes to the checkout, which he will be able to scratch subsequently in order to view the draw on his mobile terminal.

Similarly, scratch cards or equivalents exist which, by means of a code revealed either automatically or by acquisition from a remote site of the Internet type, make it possible to download a game for a mobile terminal. In this case, the ticket is simply a means for payment of a game which can be downloaded onto a mobile terminal, whereas in the present invention, the mobile terminal is an accessory which makes it possible to materialize the draw already carried out when the ticket is purchased, without it being possible for the player to intervene in it.

Some years ago, smartphones were developed, and nowadays a very large proportion of people from all generations have a device of this type. To this are added digital tablets, which are the equivalent of a portable computer without a keyboard, which are in general very light and have a certain autonomy, thus facilitating their use in "roaming" mode. These devices, i.e. smartphones or digital tablets, are known as "mobile terminals" hereinafter.

One of the advantageous properties of the "mobile terminals" is that they have one or more lenses which make it possible to take either digital photos or videos which are also digital, or both. As well as the conventional use of these lenses to take images or videos of the "souvenir" type, they are often used by specific applications to scan a barcode, and often a two-dimensional barcode. Thus, by using the image(s) derived from taking a photo or video, a specific application can decode the code scanned, and process this code accordingly, and the images generated have no use apart from this extraction. It is also possible, using multiple images generated by a lens, to create a single one by means of a computer process, and to apply a process of extraction of the code from this resulting image. The multiplicity of images can simply be derived from taking a conventional video, or be obtained by controlling the taking of this multiplicity of photos by the application which controls the lens. Hereinafter, irrespective of the variants used, this operative mode is known as "flashing", and consequently the fact of "flashing" a barcode or the equivalent with a mobile terminal consists in aiming with one of the lenses of the mobile terminal at the barcode or equivalent to be processed so that the application which controls the "flashing" can at the same time decode this code and apply associated processing. This "flashing" can be controlled by the application, i.e. the application will assist the user to ensure that the code to be flashed is entered in a specific area of the screen of the mobile terminal. In the type of application which uses flashing of this type, reference can be made to those which make it possible to identify an article by means of its barcode, and those which make it possible to go to an Internet site relating to a display on which a 2-D barcode has been inserted for this purpose.

The present invention makes it possible to retain the "scratch card" as a physical support when the player makes his selection, whilst proposing on the basis of this ticket a video which is transferred to the "mobile terminal" of the player, and will have the purpose initially, if necessary, of defining the win possible, and then making it possible to follow with what corresponds to the draw, so that the "player" firstly determines whether he has won, and, when several wins are possible, he ascertains the win in question. This draw can be preceded by definition of the conditions on which the win will apply. Thus, if the draw takes the form of a horse race, it will be determined on which horse the player is betting, and what its classification must be at the finishing post in order to expect a win, the win being able to be modulated by the classification obtained and by an amount associated with the horse. This amount can be either the real amount applicable for the horse which was offered during the real race, or an amount specifically defined for this scratch card, or for a series of scratch cards. More complex draws can be provided, based on the many horse race bets which exist. In this case, the race which constitutes the draw can then be chosen in relation to a real race, selected in the form of an outcome which stimulates the emotion of the player, such as, for example, a horse which seems to have lost the race and ends up winning, or on the other hand a horse which does not leave its adversaries any opportunity. In all cases, the real names of the participants can have been retained or replaced, in order to prevent the player from guessing the outcome of the race too easily. In this case, the real characteristics of the race can be revealed to the player either at the end of the draw sequence or in the form of bonuses in videos for the general public, by means of a complementary action by the player, or when it is detected that the player is accessing the video for at least the second time.

In order to materialize the draw, use can also be made of a sports sequence such as a cycling race, or any competition which results in a classification or medal, such as an event in the Olympic Games or a team sport event. This can also consist in whether or not a performance level is achieved, such as achieving a maximum pre-established time over a course for any activity which does or does not involve sports, a predetermined number of obstacles cleared without hindrance, or undertaking any performance to be defined. Use can also be made of a casino game draw, which unlike the present "scratch cards" can actually be experienced by the player as if he were at the casino, since he will be provided with a real video sequence. It will be appreciated that there are many other possibilities for materializing the draw, which have no limits other than the imagination of the designer who will implement the present invention.

Another one of the advantages is that, after the ticket has been revealed as a winner or a loser, according to a particular embodiment of the invention it will be possible for the player to replay the video sequence which materializes the draw as many times as he likes, in particular if he still has the ticket. According to another embodiment, once the draw has been carried out, the player can download the video of the ticket played onto his "mobile terminal" or any other computer support. This can allow him for example to replay the draw in which he has won a substantial prize, to friends or relations, thus increasing the attraction of the invention for people who buy tickets associated with it.

The invention is particularly relevant for predetermined draws, i.e. when issued, the ticket is either a loser or a winner, and in this case the value of the wins is also determined. It is however possible to conceive of an embodiment in which this determination takes place after the issue of the ticket itself: in this case, the association between the codes encoded graphically on the tickets and the "added-value videos" takes place after this determination, and therefore after the tickets of the draw have been issued.

A description is provided hereinafter of the method according to a preferred embodiment, i.e. with the draw predetermined before the tickets are created.

For the purpose of simplification, it is considered that a draw makes it possible to associate a win with each ticket. With the win being defined as the value of the ticket after the draw, this win can be zero (losing ticket) or a value equal to, or lower than, the purchase value of the ticket (consolation prize). The ticket can clearly have a value greater than its purchase value ("winning" ticket).

Before describing the method, some definitions are given:

A real video is a video sequence corresponding to a real past event, the outcome of which is revealed by viewing it. The events concerned are for example, and not exhaustively: all or part of a horse race, all or part of a sports race, which is or is not associated with an official competition, all or part of a match between a plurality of competitors, such as a football or tennis match, all or part of a performance event, or all or part of an event for which a multiplicity of outcomes can be defined.

A virtual video can be associated with the same type of events as a real video, but is created by means of computer software which permits the creation of image sequences, which are or are not based on real images.

Hereinafter, at the free choice of the creator of the invention, a video will be a real video, a virtual video, or any combinations of real and virtual videos, in this case a virtual video being able to be constructed by using one or more "real videos" as a basis.

Hereinafter, it is necessary to distinguish the "unprocessed video" which is a succession of images which materialize an event such as a horse race, whether this event has really existed or not, without a bet. This means that the "unprocessed video" is neither a winner nor a loser, since it is not associated with one of the possible outcomes, and does not designate for example which is the winning horse or the amount for a horse. If the video represents a casino roulette game, it shows for example a draw in which the result is the number 8, but it does not indicate whether a bet has been placed on the 8 or on another number, or on a particular category (even/odd, red/black, etc.), and nor does it indicate that a bet has been placed.

Thus, an unprocessed video can be associated with several wins or losses. For example, for the casino roulette game which indicates that the number 8 is a winner, the following wins and losses can be associated:

Betting 2 euros on odd, therefore a loss ("win" of 0 euros);
Betting 1 euro on the first 12, therefore a win of 3 euros;
Betting 100 euros on the 8, therefore a win of 3600 euros;
etc.

Hereinafter a "win" means the value of the ticket once the draw has been carried out, which includes the value 0 (losing ticket), and any value which is less than, equal to, or more than the purchase value of the ticket, in the case when the ticket has a purchase value, as well as any material or non-material prize such as, non-exhaustively, a cash prize, a piece of equipment, a car, a voucher, travel, or participation in a sports, cultural or "celebrity" event, etc.

An unprocessed video associated with a bet as previously indicated, and therefore with a specific "win", is known as an "added-value video" hereinafter, and an unprocessed video is thus a video which does not have added value. From the technical point of view, different "added-value videos" can be based on identical resources, and thus, taking the preceding example once more, it is possible to create a first "added-value video" which corresponds to a bet of 1 euro on the 8, and another which corresponds to a bet of 5 euros on the 8. For persons skilled in the art who are to create these two "added-value videos", it is apparent that they can use common computer resources, with the bet then being able to be defined as an associated parameter external to these resources.

BRIEF SUMMARY OF THE INVENTION

This invention is particularly relevant for being implemented from a "mobile terminal". These devices have the particular feature of having computer intelligence comparable to that of a personal computer, of having in general a network connection, of having at least one photo and/or video lens, as well as at least one screen which makes it possible to view videos, plus integrated loudspeakers and/or a headphone socket in order to be able to listen to sound, in particular the sound associated with the video sequence viewed. In general, "mobile terminals" have characteristics which are amply sufficient for implementation of the invention in terms of:

network access (via telephony of 3G or better for example, or Wi-Fi, Bluetooth, etc.), in order to access remote Internet sites, thus making it possible inter alia either to download image sequences or to display them continuously (streaming);

computing power and storage capacity, as well as the capacity to integrate specific applications such as those planned within the context of the invention;

quality of the photo and/or video lens in order to flash conventional or 2-D barcodes or the equivalent;

quality of the screen for viewing videos;

quality of the sound of the device to listen to the sound associated with a video, sound being recommended within the context of the present invention, but not indispensable.

Furthermore, these characteristics are destined to improve with time: future models will probably have enhanced performance in comparison with the present models in all the aforementioned respects.

Although the invention is particularly designed for the above-described "mobile terminals" it can also be implemented on any non-mobile computer system, or any assembly of computer elements or the like which incorporates the equivalent of a photo and/or video lens, the equivalent of a screen, and a network connection, all being controlled by intelligence of a computer type. Any device thus constituted may be used within the context of the invention instead of, and in place of, a "mobile terminal".

A definition is now also given of one of the present modes of displaying videos known as streaming, which defines a mode of displaying remote videos without really downloading them. Only a small part of the video is stored temporarily in a buffer area in order to permit the reading action carried out by the user. Storage in a buffer area makes it possible inter alia not to interrupt the reading in the case of a temporary and limited anomaly in the network transfer. Thus, hereinafter, a definition is given of two modes of reading a remote video:

Reading by means of downloading: in other words the video is firstly downloaded onto the mobile terminal before being accessed for reading. This mode makes it possible, if the application which shows this video permits it, to view the video again subsequently without accessing again the remote Internet site on which this video was stored. In certain cases, viewing by means of this mode is possible before all of the video has been downloaded. In this case, it is desirable for the remainder of the downloading to be carried out fast enough for the display in progress not to be interrupted. Hereinafter, "reading by means of downloading" will mean any present or future mode which makes it possible to view a remote video on a mobile terminal whilst retaining the video on the "mobile terminal", in order for it to be able to be viewed again, if this is authorized, without needing to access again the Internet site from which it is obtained.

Reading by means of streaming: the video is read without it being completely downloaded. This mode incorporates any method which makes it possible to view a remote video without it being previously downloaded onto the mobile terminal, and which requires new remote access if the video is to be viewed again, the video not being retained on the "mobile terminal" after it has been viewed at least seemingly. Hereinafter, "reading by means of streaming" means any present or future mode which makes it possible to view a remote video on a mobile terminal without being able to retain the video on the mobile terminal. Once the first session of connection to the Internet site from which it is obtained has been interrupted, reconnection to this site is necessary, if authorized, in order to view this video again.

One of the preferred embodiments of the invention is a method which consists in:

creating an application which can be loaded or downloaded onto a mobile terminal which:

interfaces with at least one of the photo and/or video lenses of said "mobile terminal", so that an image or a collection of images can be created when the user of said "mobile terminal" flashes the area of a ticket created within the context of the invention, which incorporates a code of a computer type encoded graphically in said area in order to extract the code from it, the taking of the image(s) and extraction of the code from the image(s) produced being carried out either by using a process external to the application of said "mobile terminal", or by using a process specifically integrated in said application, or by means of a combination of these processes;

interfaces with the screen of the mobile terminal, or at least one of its screens in the case of a plurality of screens, in order to allow draw videos to be read on it. This interface can also be used to optimize the detection of the code to be extracted from the ticket, or to assist the user in taking the image;

interfaces with a remote site such as an Internet site in order to search on it for the video associated with the ticket flashed;

interfaces with the processor or any equivalent intelligence of the "mobile terminal" in order to run the processing operations which come within the scope of the invention;

defining a draw, consisting in definition of the tickets to be issued and their possible nominal value, definition of the wins and their distribution relative to the collection of tickets to be created. The tickets are produced by printing or an equivalent operation on physical supports such as cardboard and/or plasticized and/or metallized supports or the equivalent;

defining a certain number of added-value videos, or videos which define:

application or non-application of theoretical correspondence with the value of the tickets to be issued;

a video sequence which implements the development of an event with a plurality of possible outcomes, but only one of which is implemented in the video;

a bet which associates one or more potential wins with one or more possible outcomes of the video sequence;

determination of the outcome of the event revealed by watching the video;

optionally determination or possible confirmation of the real win associated with the ticket;

creating a specific computer code for each ticket of the draw:

depending on the nature of the draw, this code can be common to a plurality of tickets;

this code must make it possible to associate an "added-value video" with the ticket, from amongst the videos selected for the draw;

encoding this code graphically on a dedicated area of the ticket and covering this area with a concealing layer which must be removed by scratching or an equivalent appropriate action by the player, in order to be able to flash this area under the control of the application, defined within the context of the invention, of his "remote terminal";

permitting payment of the player's win, when the win is not zero, either by exchanging the credit at an associated sales point, or by crediting the win to an account designated by the player.

DETAILED DESCRIPTION OF THE PREFERRED EMBODIMENTS

Figure 1:
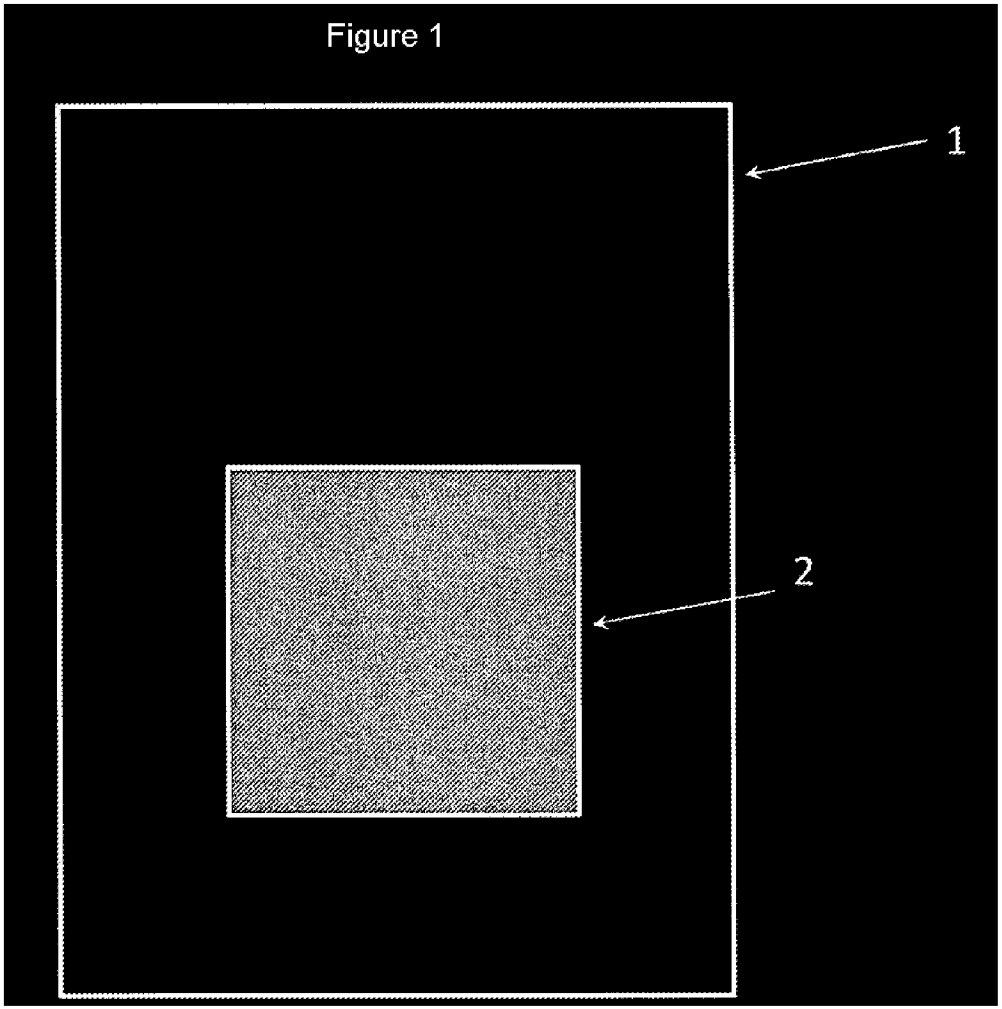
FIG. 1 illustrates a scratch card (1)

FIG. 1 shows highly schematically a scratch card (1) which consists mainly of a physical support with a variable format which ranges from the approximate format of a credit card up to formats of A5 type (half an A4 page) or the equivalent for complex tickets which incorporate multiple draws, i.e. several chances of winning, which are or are not cumulative. It will be appreciated that any format outside these limits continues to be compatible with the present invention. Similarly, the conventional support of a card stock type can be chosen freely: any kind of support can be selected which incorporates paper, plastic, metal, as well as any presently known or future simple or complex support which makes it possible to insert a graphic area which encodes a computer value such as, in a non-limiting manner, a conventional barcode or a 2-D barcode. The selection of the materials of the support is mainly determined by:

marketing constraints aimed at making the ticket attractive;

physical constraints associated with the strength of the ticket. Thus, it is perfectly possible to select as a support paper with a low gram weight, but in this case the ticket will be fragile and will be able to be damaged easily. However, this fragility need not be an obstacle in the case of organization of certain draws such as those associated with fairs;

security constraints, such as the opaqueness of the ticket, so that it cannot be exploited by transparence, or the insertion of technical control areas when the value of the potential wins justifies this;

legal constraints such as those relating to information for the player.

The area (2) to be revealed by scratching is either inserted simultaneously with the printing of the other areas of the ticket, or inserted by means of a separate process. This area uses any graphic technique or the equivalent which permits encoding of a computer value which makes it possible to associate this ticket with its corresponding video, irrespective of the indexing method selected. The encoding can for example use a barcode with one or two dimensions from amongst the codes which already exist, either specially defined within the context of the invention for a particular draw, or for a multiplicity of draws. It is also possible to use a watermarking method which permits encoding of this value using predetermined graphics, whether these graphics are the same for all the tickets of a single draw, or whether they are associated with a sub-assembly of these tickets.

A concealing layer is added on top of the support itself, so that the code cannot be exploited before this layer is eliminated by any suitable method. Within the context of certain draws, where for example the potential wins are not very large, this concealing layer need not be added. Similarly, if the tickets are distributed before the remote site which makes it possible to access the videos is active, concealing layers need also not be added, since in this case decrypting the code does not make it possible to identify the associated win until this site is active. The same can apply if a security device allows the player to determine whether the ticket has already been used or not.

Figure 2:
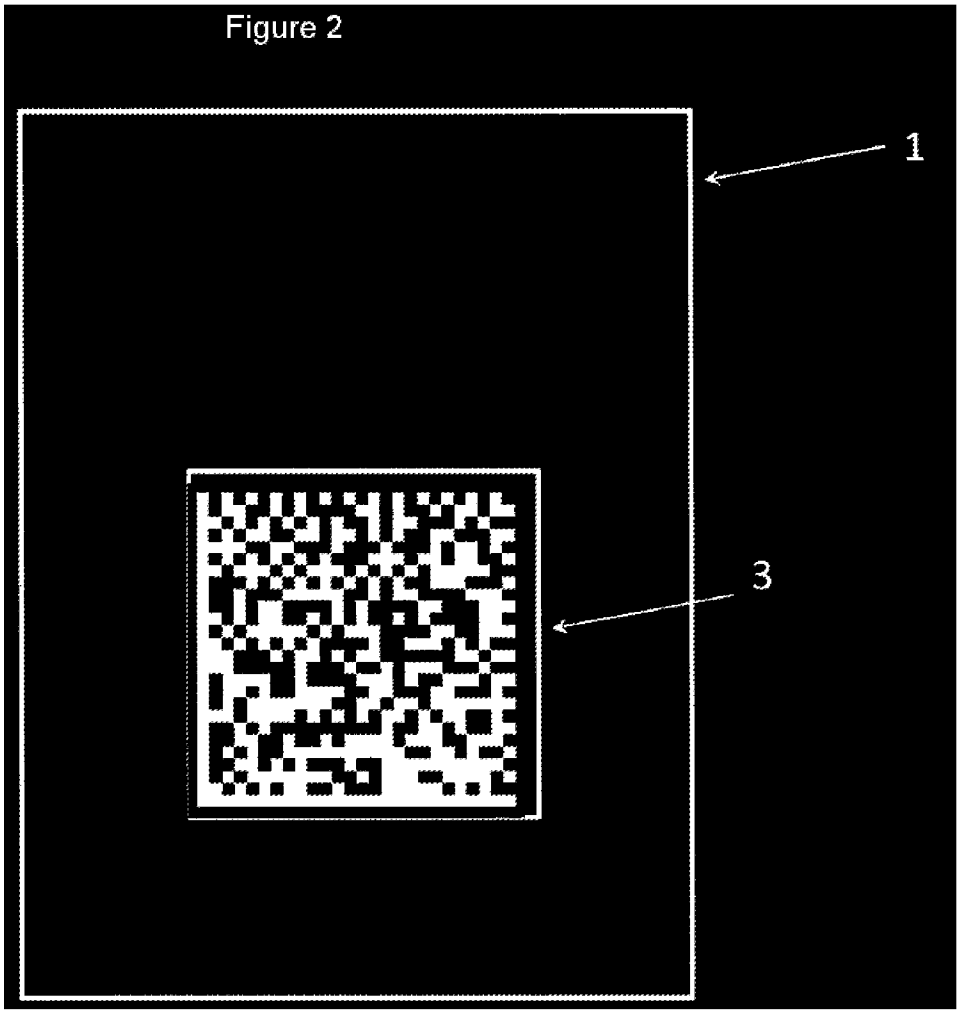
FIGS. 2 and 3 illustrate a scratch card (1) after scratching or an equivalent operation.
Figure 3:
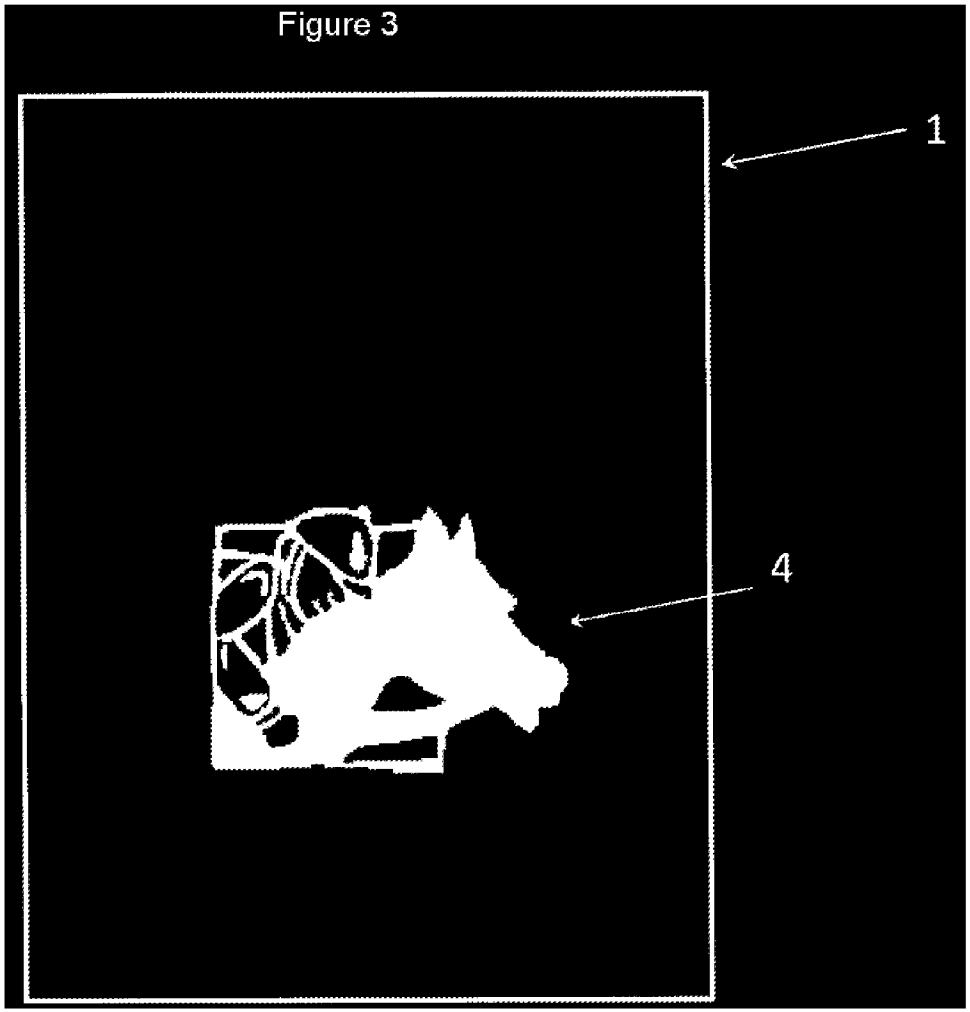

FIG. 2 illustrates a scratch card (1) when the concealing layer has been eliminated by an action of scratching or the equivalent, or when the same ticket does not have a concealing layer. In the case of this figure, the code which is associated with the ticket, and makes it possible to view the associated video sequence by flashing by means of a mobile terminal, takes the form of a 2-D barcode (3). However, any encoding method is satisfactory provided that decoding can take place by means of the image or collection of images which a mobile terminal can flash by taking a photo, video scanning, or any equivalent operation, and thus obtain the video which is associated with the ticket. Thus, in FIG. 3, the area revealed is an image (4) which can also incorporate appropriate encoding by means of any watermarking method or the equivalent.

Figure 4:
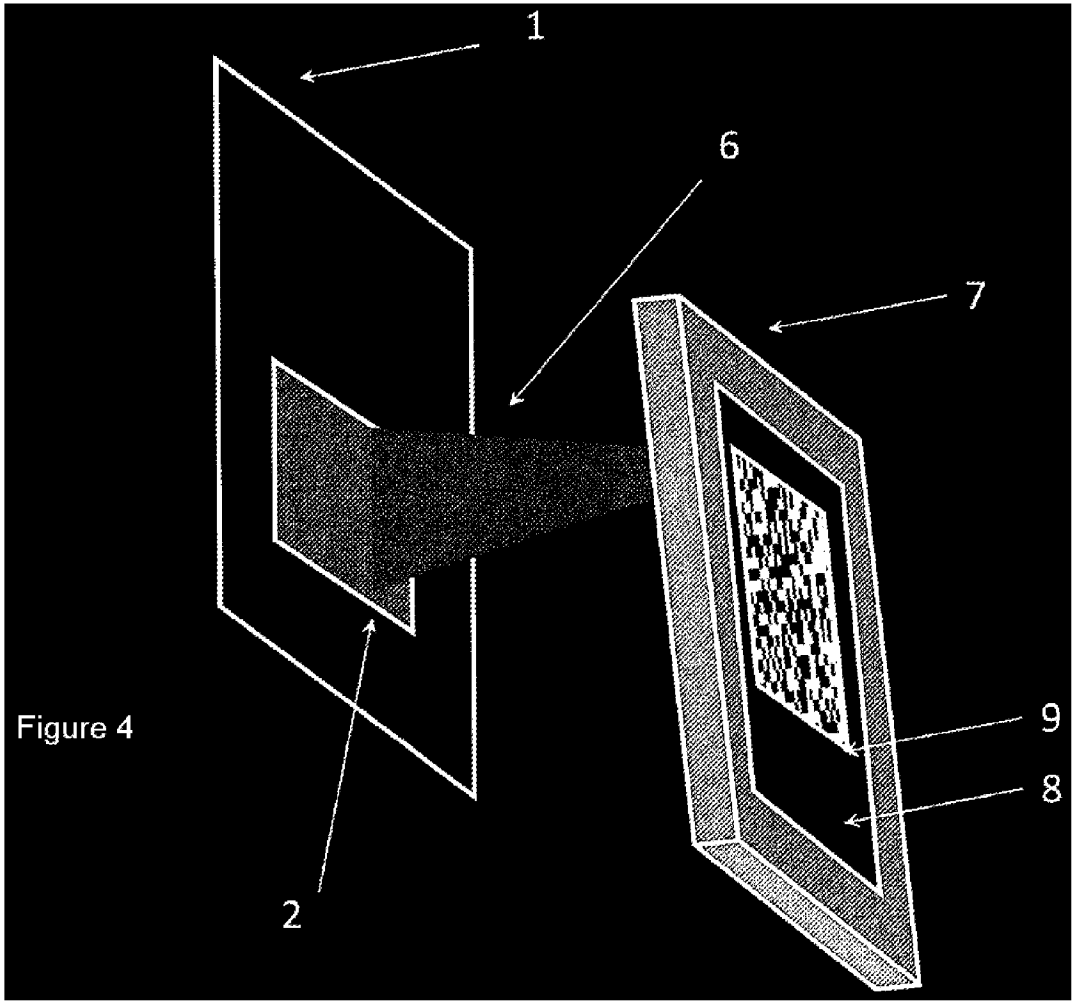
FIG. 4 illustrates the mode of flashing or the equivalent by a mobile terminal (7) of the area (2) revealed by the operation of scratching or the equivalent.

FIG. 4 illustrates the mode of acquisition of the code revealed by a "mobile terminal" (7) or the equivalent. In this case, a specific application has previously been loaded or downloaded onto the "mobile terminal", whether this application is specific to a draw, or common to a multiplicity of draws, and/or whether this application makes it possible to process other codes which are not associated with the present invention. When this application is activated by the mobile terminal, the image (9) perceived by the lens of the mobile terminal is displayed on the screen (8) of the latter. In the case of a multiplicity of lenses, one or more of these lenses can be used within the context of the invention. Displaying of the image (9) perceived by the lens on the screen (8) of the mobile terminal (7) makes it possible to frame the encoded area (2) when it is flashed (6) by the mobile terminal (7), which encoded area was below the concealing layer in the case of preexistence of this concealing layer. Depending on the application available, in order for it to be able to be exploited, it will be necessary for either all of the encoded area to be entered on the screen of the mobile terminal or in a particular area of it, whether this area is materialized or not by the application used. Thus, according to a particular embodiment, the flashed area (2) is not materialized on one of the screens of the "mobile terminal", and in this case the application exploits directly the image(s) generated by the lens, provided that it/they is/are satisfactory for exploitation by said application. The display of the image on the screen of the mobile terminal will be either the image derived directly from the video shot (6) or photo shot (6) of the lens used, or an image or series of images obtained by means of a specific process controlled by the application used. Thus, this application will be able to use the different parameters associated with the movement of the mobile terminal and/or the positioning relative to the ticket exploited, whether all of these parameters are obtained by specific sensors of the mobile terminal, or by appropriate particular functions, or by combination of these elements. The link to the associated video can be established automatically, provided that the application has been able to decode the code (2) flashed, or provided that it determines that there is an image or a satisfactory collection of images in order to obtain this decoding. The link can also be established by a complementary action by the player, when he considers that the framing carried out is satisfactory in order for the application to be able to proceed with the decoding, on the basis, or not on the basis, of signals supplied by the application. Thus, when the link is established, according to a particular embodiment of the invention, the video is initialized on one of the screens of the mobile terminal. According to another particular embodiment of the invention, the initialization of this video requires a specific action by the player.

Figure 5:
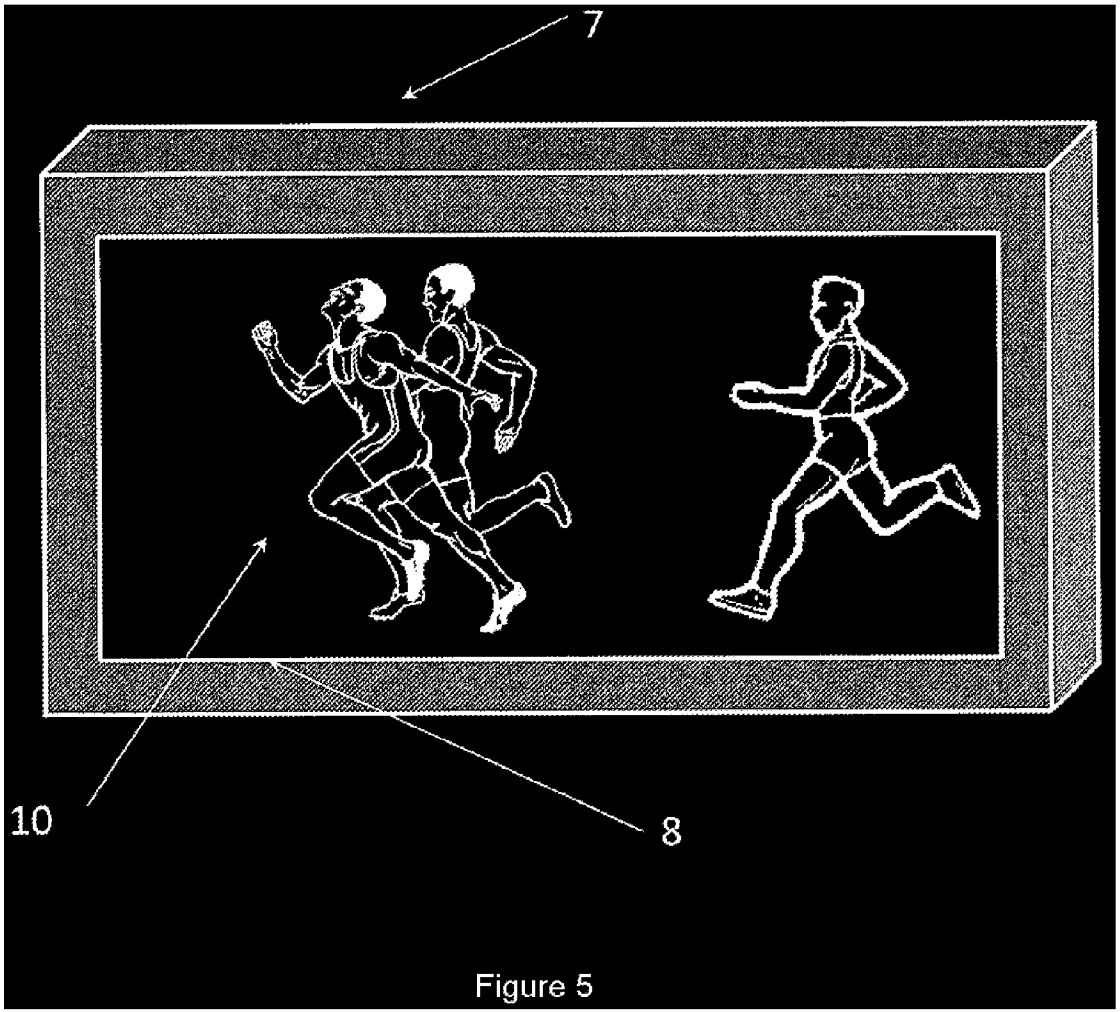
FIG. 5 illustrates the video (10) played on the mobile terminal (7) resulting from the flashing or the equivalent of the area revealed by means of the scratching operation or the equivalent.

FIG. 5 illustrates the viewing of the video (10) on one of the screens (8) of the "mobile terminal" (7), after the successful flashing (6) of the encoding (2) present on the ticket (1). This video (10) is triggered either automatically, provided that the application of the "mobile terminal" (7) has succeeded in decoding the code (2) contained on the ticket (1) after the flashing operation (6), or after an action by the player further to the successful flashing (6), optionally after having been prompted by the application loaded onto the mobile. If necessary, the first phase of the video defines the characteristics of the draw, by indicating some or all of the following elements:

- nature of the event involved in the draw, i.e. sports competition, horse race, casino game, etc. In order to add to the attraction of the game, the specific nature of the event can be indicated, whether this is real or imaginary, i.e. athletics event from the latest Olympic Games, match ball of a major tennis tournament, official attempt at a record, etc.;
- the condition on which a non-zero win applies, i.e. a horse which comes within the first three, successful match ball, record established, etc.;
- potential bet and win: it can be indicated that the bet of this ticket is 100 euros, even if the purchase value is completely different, such as, for example, 1 euro. This bet is known as a "fictitious bet" hereinafter. For the win, there can be one possible non-zero win or a plurality of them, for example a win of 5 times the "fictitious bet" if the match ball is successful, a win of 10 times the "fictitious bet" if the record is established, a win of 10 times the "fictitious bet" if the designated horse comes first, twice this amount if it comes second, and once if it is third, and a win of 0 if the horse is fourth or more. In the case of an endurance test, such as, for example, an object which must remain balanced for more than 10 seconds, the win will be once the bet for each second which elapses after these 10 seconds, and the potential win can be displayed as the time goes beyond the threshold established;

mini video presenting the protagonists involved in the performance. Thus, for example, it can show the horse on which the player is betting in the presentation paddock, or the tennis player on whom the player is betting, warming up. This mini video can incorporate or merge the other elements of this first phase of the video, such as definition of the "fictitious bet" and winning conditions.

At the end of this first phase, automatically or controlled by the player, the video which constitutes the draw is viewed on one of the screens of the "mobile terminal". In the figure in question, there is simulation of an athletics race. In this video, in the case of a race for example, the competitor on whom the player is betting can be indicated specifically, for example by means of an added arrow. The video can be associated with a commentary, for example that of the commentator at a horse race, this commentary being able to be general or specific to the outcome of the competitor on whom the player is betting. Certain phases of the draw, in particular those which make it possible to determine the win, can be processed specifically, thus, passing the post in a horse race or the finishing line in an athletics race can be viewed in slow motion. It is also possible to follow the viewing of the event by a replay of the final phase, with devices such as slow motion and/or precise materialization of the finishing line, and/or display of the arrival, as this line is crossed. The application will be able to allow viewing of the video to be controlled by the user of the mobile terminal with conventional actions for videos such as "pause", "slow speed", "speeded up", "rewind" and "zoom", as well as any possible existing or future action relating to the playing of a video.

A final phase allows the win to be displayed. This final phase either follows directly the preceding phase corresponding to the draw itself, or it is triggered by a specific action by the player. In addition to displaying the win, the player can be offered additional options:

Cashing in. The application can then propose cashing the win in directly into an account already specified by the player, or to be specified after implementation of the application, whether this account is a bank account which is independent from the organizer of the draw, or a special account controlled by the latter;

Storage of the video. The player may wish to keep the video relating to the draw, particularly in the case when this corresponds to a win. In this case the application can propose freely accessible storage of this type either on the "mobile terminal", or via an application determined in specific conditions, or in a dedicated account such as an email address, the address of an electronic safe, or the equivalent.

Viewing all or part of the video again.

Figure 6:
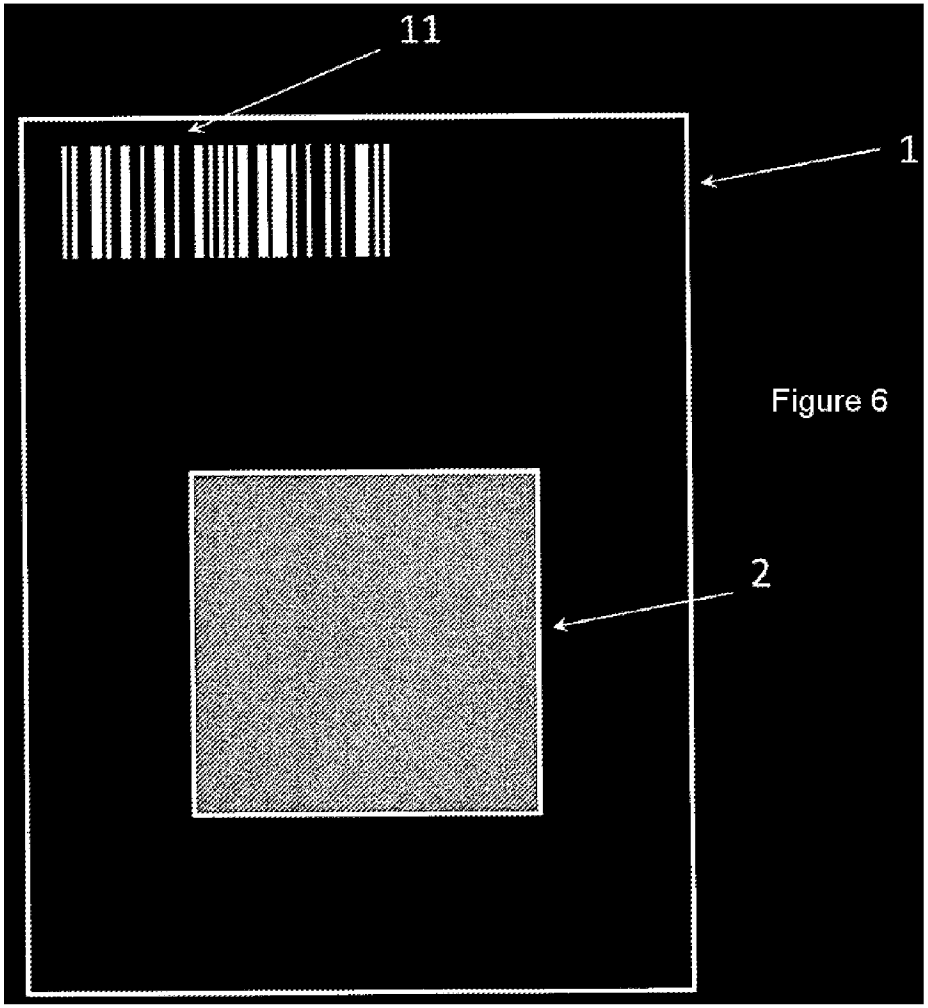
FIG. 6 illustrates a scratch card (1) comprising a complementary security barcode (11).

FIG. 6 illustrates a scratch card (1) according to the invention on which there is added a complementary code (11) known as a "check code" hereinafter. This code (11) does not need to be concealed. Exploitation of this code (11) by a specific application known hereinafter as the "checking application", which is optionally merged with the preceding application for control of the draws on the "mobile terminal", makes it possible to ascertain whether the ticket has already been used or not. This can be carried out at the moment when the ticket is bought, to check whether the ticket (1) has already been viewed, in order to prevent any fraud. In this case, the ticket (1) has a unique reference which is controlled on a remote server. On this server, this reference makes it possible optionally to determine some or all of the associated information, such as identification of the draw associated with the ticket, its purchase value, its date of issue, its final date of use, and the sales point by which it is distributed. However, this reference does not make it possible to determine the win associated with the ticket (1). According to a particular embodiment, this information can be obtained from this code (11), but only by a "checking application" specific to restricted distribution. However, this embodiment is more suitable for draws which are not associated with large wins, such as may be the case for certain commercial promotions or draws associated with fairs. In order for the usage information to be accessible, either the first time the video associated with the ticket is viewed, or each time it is viewed, storage of the viewing is carried out either specifically, i.e. time, date, identity or equivalent of the player, geographical location, etc., or it is carried out in a binary manner, i.e. viewed at least once or never viewed. The number of viewings can also be controlled. On the basis of this control, the specific "checking application" can thus identify whether the ticket (1) is new, i.e. that it has never been used, or on the other hand whether it has already been used, and in this case, if the associated control and also the specific "checking application" make this possible, what were the characteristics of these usages. This specific "checking application" can be available either to the player so that he can check his ticket (1) when he buys it, or to the controller of the sales point, in order to verify that the ticket is new when it is issued, or is accessible to both of them. Activation of the "checking application" can itself form the basis of a check, in order for example to prevent the player from disputing the "newness" of his ticket (1) when it is bought. This type of check is suitable for the mode of disclosing the win of the tickets within the context of the present invention. It can advantageously be completed by any existing or future security systems relating to this type of ticket, such as a check code revealed by additional scratching, which can be used, under penalty of invalidity, only by people who are identified as the employees of certain sales points.

Also, in general:

The fact of being able to view the video associated with a ticket several times can form the basis of limitations involving either the number of viewings or definition of the viewing period authorized. It is also possible to define limitations according to the geographical area, i.e. a ticket may be able to be activated only in a given country or geographical areas, or on the other hand it may not be possible to activate it in certain countries or geographical areas, in particular in order to comply with local or national legislation. In this case, the application downloaded onto the mobile terminal will be able to use a tracking system.

If the ticket is associated with a win which can be cashed in, this will be able to be obtained either manually or by exchanging the winning ticket at a dedicated sales point, which will then be able to have an application making it possible to check the win associated with the ticket. This application, known as a "payment application" hereinafter, can be activated by flashing the 2-D barcode or the equivalent revealed by the player, in this case with the application simply searching for the value of the win payable, and permitting recording of the payment when it has been made, so that the ticket cannot permit further cashing in, either at the same sales point or at another sales point using the same ticket or a copy of it. This mechanism is equally suitable if the win is of a material or non-material nature.

The invention claimed is:

1. A lottery method comprising:

defining a draw comprising definition of tickets to be issued and respective possible nominal values of the tickets to be issued, definition of wins and respective distributions of the wins relative to collection of the tickets to be created, the tickets being produced by printing on physical supports;

defining a specific number of added-value videos, which define:

application or non-application of theoretical correspondence with values of the tickets to be issued, a video sequence which represents a progressive development of a physically realistic event with a plurality of possible outcomes, but only one of the plurality of possible outcomes is represented by the video, a bet which associates one or more potential wins with one or more possible outcomes of the video sequence, determination of the outcome of the physically realistic event revealed by watching a predetermined progressive video, and optionally determination or confirmation of a real win associated with the ticket;

after defining the draw and defining the specific number of added-value videos, creating a specific computer code for each one of the tickets of the draw which associates the one ticket with one of the added-value videos from amongst the added-value videos selected for the draw;

after creating the specific computer code for the one of the tickets, encoding said specific computer code graphically on a dedicated area of the one ticket and covering said dedicated area with a concealing layer which is configured to be removed by scratching or an equivalent appropriate action by a player, in order to flash the dedicated area under control of an application of a mobile terminal of the player;

after said encoding said specific computer code graphically on the dedicated area of the ticket, distributing the tickets to a plurality of users;

after said distributing the tickets, receiving from a mobile terminal a code that was extracted from said specific area of a ticket of the tickets by flashing said ticket, and searching a remote site for the predetermined progressive video associated with said ticket; and after the receiving the code, playing the predetermined progressive video on a display of the mobile terminal, a specific outcome of the predetermined progressive video representing a winning status of the ticket.

2. The lottery method as claimed in claim 1, wherein the application which is loaded or downloaded onto the mobile terminal extracts the specific computer code encoded graphically on the ticket from one or more images produced by flashing the specific computer code via a sensor of the mobile terminal by a specific extraction process.

3. The lottery method as claimed in claim 1, wherein the application which is loaded or downloaded onto the mobile terminal extracts the specific computer code encoded graphically on the ticket from one or more images produced by flashing the specific computer code via a sensor of the mobile terminal by an extraction process which is incorporated in the mobile terminal, independently from said application.

4. The lottery method as claimed in claim 1, wherein the application which is loaded or downloaded onto the mobile terminal extracts the code encoded graphically on the ticket from one or more images produced by flashing the specific computer code via a sensor of the mobile terminal by a combination of at least one extraction process which is incorporated in the mobile terminal independently from said application, and at least one extraction process which is specific to said application.

5. The lottery method as claimed in claim 1, wherein, during flashing of the dedicated area of the ticket which incorporates the specific computer code encoded graphically, the flashed area is displayed on a screen of the mobile terminal, in order to assist a user in facilitating detection and decoding.

6. The lottery method as claimed in claim 1, wherein the specific computer code which is encoded graphically on the ticket is common to a plurality of the tickets of a same draw.

7. The lottery method as claimed in claim 1, wherein the ticket is one or more of produced and distributed before the concealing layer is provided to cover the dedicated area.

8. The lottery method as claimed in claim 1, wherein the physically realistic event which has been used as a support for the definition of the video associated with the ticket forms a basis of access which is complementary to an outcome of the draw, or when the video associated with the draw is viewed again.

9. The lottery method as claimed in claim 1, wherein the video which is associated with the ticket is downloaded onto the mobile terminal or onto another computer support in order to be able to be viewed again independently from the draw associated with said ticket.

10. The lottery method as claimed in claim 1, wherein the winning status associated with the ticket is defined after the ticket has been issued, and the association between the codes which are encoded graphically on the tickets and the added-value videos is carried out after the winning status is determined, and thus after the tickets of the draw have been issued.

11. The lottery method as claimed in claim 1, wherein the video which is associated with a ticket is constituted by all or part of the video of a real event.

12. The lottery method as claimed in claim 1, wherein the video which is associated with a ticket is created by computer software, while being based or not based on real images.

13. The lottery method as claimed in claim 1, wherein the video which is associated with a ticket is a combination of video sequences obtained from one or a plurality of real events and video sequences created by computer software, while being based or not based on real images.

14. The lottery method as claimed in claim 1, wherein a plurality of the added-value videos are produced from a same non-added-value video.

15. The lottery method as claimed in claim 1, wherein viewing of the video associated with the ticket is accompanied by a soundtrack.

16. The lottery method as claimed in claim 1, wherein the ticket is used by an assembly of computer elements comprising at least one sensor, at least the equivalent of one screen, and a network connection, all of the computer elements being controlled by computer intelligence instead of, and in place of, the mobile terminal.

17. The lottery method as claimed in claim 1, wherein the video which is associated with the ticket is downloaded onto the mobile terminal in order to be viewed, the viewing being able to begin before the video is completely downloaded, and, when permitted, the video is configured to be viewed again on the mobile terminal without needing new network access to the server from which the video was downloaded.

18. The lottery method as claimed in claim 1, wherein the video associated with the ticket is viewed in a streaming mode.

19. The lottery method as claimed in claim 1, wherein the encoding on the ticket is carried out by a conventional or 2-D barcode.

20. The lottery method as claimed in claim 1, wherein the encoding on the ticket is carried out by watermarking based on an image.

21. The lottery method as claimed in claim 1, wherein flashing of the encoded area on the ticket is carried out without a control display on a screen of the mobile terminal.

22. The lottery method as claimed in claim 1, wherein viewing of the video which is associated with the ticket is initialized on the mobile terminal with or without triggering by the player after a successful flashing operation.

23. The lottery method as claimed in claim 1, wherein viewings of a video associated with a ticket form the basis of control on a dedicated server, the control enabling identifying whether the corresponding ticket has been used at least once to view the associated video.

24. The lottery method as claimed in claim 1, wherein a check code is encoded on the ticket in a manner complementary to the specific computer code enabling access to the associated video, the check code using any type of encoding.

25. The lottery method as claimed in claim 24, wherein a dedicated application is created independently from the application for use of the code, or is incorporated in the specific computer code, thus making it possible, by appropriate reading of the complementary check code, to verify whether the ticket has already been used, without needing to reveal the specific computer code when the specific computer code is concealed.

26. The lottery method as claimed in claim 25, wherein the application which uses the check code establishes a diagnosis by interfacing with a server which controls access to the associated videos by using the specific computer code of the ticket which incorporates a security code.

27. The lottery method as claimed in claim 1, further comprising:

creating the application configured to be loaded or downloaded onto the mobile terminal which:

interfaces with at least one image sensor of said mobile terminal, so that at least one image or a collection of images are created when one of the users that uses said mobile terminal flashes the dedicated area of the ticket, the dedicated area comprising the specific computer code encoded graphically, in order to extract the specific computer code from said dedicated area;

interfaces with at least one screen of said mobile terminal, allowing draw videos to be read on said display, and interfaces with a remote site in order to search on said remote site for the video associated with the ticket flashed.

* * * * *